US010224681B2

(12) United States Patent
Kikuchi

(10) Patent No.: US 10,224,681 B2
(45) **Date of Patent: *Mar. 5, 2019**

(54) MULTIPOLE PLUG

(71) Applicant: NIPPON DICS Co., Ltd., Tokyo (JP)

(72) Inventor: Eiji Kikuchi, Tokyo (JP)

(73) Assignee: NIPPON DICS CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/013,538

(22) Filed: Jun. 20, 2018

(65) Prior Publication Data

US 2018/0301856 A1 Oct. 18, 2018

Related U.S. Application Data

(62) Division of application No. 15/560,252, filed as application No. PCT/JP2017/017906 on May 11, 2017, now Pat. No. 10,063,020.

(30) Foreign Application Priority Data

Jun. 16, 2016 (JP) ..... 2016-119980

(51) Int. Cl.
*H01R 24/58* (2011.01)
*H01R 13/04* (2006.01)
(Continued)

(52) U.S. Cl.
CPC ..... *H01R 24/58* (2013.01); *H01R 13/04* (2013.01); *H01R 43/20* (2013.01); *H01R 2107/00* (2013.01)

(58) Field of Classification Search
CPC ..... H01R 24/58; H01R 13/04; H01R 43/20; H01R 2107/00
(Continued)

(56) References Cited

U.S. PATENT DOCUMENTS 4,325,599 A 4/1982 Feldman
5,820,416 A * 10/1998 Carmichael ..... E21B 17/028 439/668
(Continued)

FOREIGN PATENT DOCUMENTS

CN 2384336 Y1 6/2000
CN 2681401 Y1 2/2005
(Continued)

OTHER PUBLICATIONS

Written Opinion of the International Searching Authority for International Application No. PCT/JP2017/017906 dated Aug. 15, 2017 (6 sheets).
(Continued)

*Primary Examiner* — Amy Cohen Johnson
*Assistant Examiner* — Milagros Jeancharles
(74) *Attorney, Agent, or Firm* — Kratz, Quintos & Hanson, LLP

(57) ABSTRACT

A multipole plug 1 is configured in such a manner that a first terminal strip (first terminal strip 15) is provided with first flow holes (second flow holes 15D) in a first curved plate portion 15B, a second terminal strip (second terminal strip 17) is provided with a second flow holes (third flow holes 17D) in a second curved plate portion 17B, and the first curved plate portion 15B and the second curved plate portion 17B are positioned by the positioning ring 20 provided with an outer projecting portions 20B to be fitted to notched portions 18F of a first sleeve portion (second sleeve 18) and an inner projecting portions 20C to be fitted into a gap between the first curved plate portion 15B and the second curved plate portion 17B being fitted thereto.

2 Claims, 12 Drawing Sheets

(51) Int. Cl.
*H01R 43/20* (2006.01)
*H01R 107/00* (2006.01)

(58) Field of Classification Search
USPC ..... 439/668, 669
See application file for complete search history.

(56) References Cited

U.S. PATENT DOCUMENTS

| | | | | |
|---|---|---|---|---|
| 5,912,433 | A | 6/1999 | Pulido et al. | |
| 6,394,852 | B1 | 5/2002 | Huang | |
| 6,439,933 | B1 * | 8/2002 | Moji | H01R 24/58 439/668 |
| 7,322,858 | B1 * | 1/2008 | Rogers | H01R 24/58 439/668 |
| 7,670,192 | B2 | 3/2010 | Wu | |
| 7,824,230 | B1 | 11/2010 | Ho | |
| 7,976,347 | B2 | 7/2011 | Zhang | |
| 8,016,615 | B2 | 9/2011 | Montena | |
| 8,206,181 | B2 | 6/2012 | Steijner | |
| 8,382,529 | B2 | 2/2013 | Lim et al. | |
| 9,199,072 | B2 | 12/2015 | Jang | |
| 9,276,348 | B1 * | 3/2016 | Vadlamudi | A61N 1/3752 |
| 9,859,605 | B2 * | 1/2018 | Mukai | H01Q 1/084 |
| 2012/0190226 | A1 * | 7/2012 | Roberts, Jr. | H01R 13/7032 439/188 |

FOREIGN PATENT DOCUMENTS

| | | | |
|---|---|---|---|
| EP | 2772995 | A1 | 9/2014 |
| JP | S58-59180 | A | 4/1983 |
| JP | 2000-340309 | A | 12/2000 |
| JP | 2001-357948 | A | 12/2001 |
| KR | 10-2016-0006907 | A | 1/2016 |

OTHER PUBLICATIONS

International Search Report for International Application No. PCT/JP2017/17906 dated Aug. 15, 2017.

Extended European Search Report for International Application No. 17755406.0, dated Aug. 8, 2018 (11 sheets).

* cited by examiner (A)

(B)

(C)

MULTIPOLE PLUG

CROSS-REFERENCE TO RELATED APPLICATIONS

This application is a Divisional of U.S. patent application Ser. No. 15/560,252 filed Sep. 21, 2017, which is a § 371 National Stage application of International Patent Application No. PCT/JP2017/017906 filed May 11, 2017, which claims priority to Japanese Patent Application No. 2016-119980 filed Jun. 16, 2016, the entire contents of each of which are incorporated herein by reference.

TECHNICAL FIELD

The present invention relates to a multipole plug.

BACKGROUND ART

In recent years, commercial presentation of high-sound quality music sources is spreading through the market, and customers' requirements for a higher sound quality are strong. In order to reproduce a high quality sound source with a high sound quality, balance connection of speakers or a head phone is required. In order to achieve the balance connection, two poles each for left and right speakers are required, so that at least four poles are required. In the case of providing a shield, five poles are required if a ground terminal is added.

In contrast, the customers also have a strong demand for carrying a reproduction apparatus that reproduces the high-quality sound source with a high sound quality. In order to apply the balance connection to a mobile high-quality sound reproduction apparatus, a multipole plug, specifically, a plug having specifically at least four poles is required.

Multipole plugs of the related art are formed by providing a center pin formed into a shaft shape as a first pole, cylindrical sleeves arranged on an outer periphery of the center pin as a second pole and so forth, and an insulation layer formed by injecting a resin between the respective poles. In the multipole plugs having such a structure, if the number of poles is four or five, the thickness of the sleeves of the respective poles is reduced, and the cross-sectional area thereof is also reduced, which may result in a high resistance value. The higher resistance value may become an obstruct for reproduction with high sound quality. In addition, since spaces between the sleeves of the respective poles are small, the resin cannot be injected well therebetween, which may result in an increased defect rate.

In view of such points, a technology in which terminal strips obtained by forming divided cylinders having a shape of a sleeve divided in a circumference direction for two or three poles, providing a ring at one end thereof in a longitudinal direction as a connecting end, and providing a bent portion at the other end thereof for positioning are disposed around a center pin is proposed (For example, PTL 1).

However, with this technology as well, injection of the resin between the terminal strips of the respective poles without leaving any unfilled space is still difficult, and another problem arises such that the length of the plug is increased due to the provision of the bent portion.

CITATION LIST

Patent Literature

Patent Literature PTL 1: Japanese Patent No. 3317683

SUMMARY OF INVENTION

Technical Problem

A problem to be solved by the present invention is to provide a multipole plug which allows a resin to be injected easily between terminal strips of respective poles and the length of the plug to be reduced.

Means for Solving the Problem

The present invention provides a multipole plug comprising: a center pin comprising a head and a shaft portion, the center pin corresponding to a first pole; a first sleeve portion formed into a cylindrical shape comprising a first flow hole in a side surface thereof and being disposed outside the shaft portion, the first sleeve portion corresponding to a second pole; a first terminal strip having a shape of an annular first ring portion and a cylinder to be fitted onto the shaft portion and divided in a circumferential direction and separated along an axial direction, being disposed outside the first sleeve portion along the first sleeve portion, and comprising a first curved plate portion comprising a second flow hole, the first terminal strip corresponding to a third pole; a second terminal strip having a shape of an annular second ring portion and a cylinder to be fitted onto the shaft portion and divided in a circumferential direction and separated along an axial direction, being disposed outside the first sleeve portion along the first sleeve portion so as to oppose the first curved plate portion, and comprising a second curved plate portion comprising a third flow hole, the second terminal strip corresponding to a fourth pole; a second sleeve portion having a notched portion notched in a radially inwardly and being disposed outside the first terminal strip and the second terminal strip, the second sleeve portion corresponding to a fifth pole; a positioning ring comprising an inner projecting portion fitted to a gap between the first terminal strip and the second terminal strip and an outer projecting portion fitted to the notched portion, and being formed into an annular shape; and an insulating resin that insulates the respective poles from the first pole to the fifth pole from each other.

Advantageous Effects of Invention

According to the present invention, a multipole plug which allows a resin to be injected easily between terminal strips of respective poles and a length of the plug to be reduced may be provided.

DESCRIPTION OF EMBODIMENTS

Figure 1:
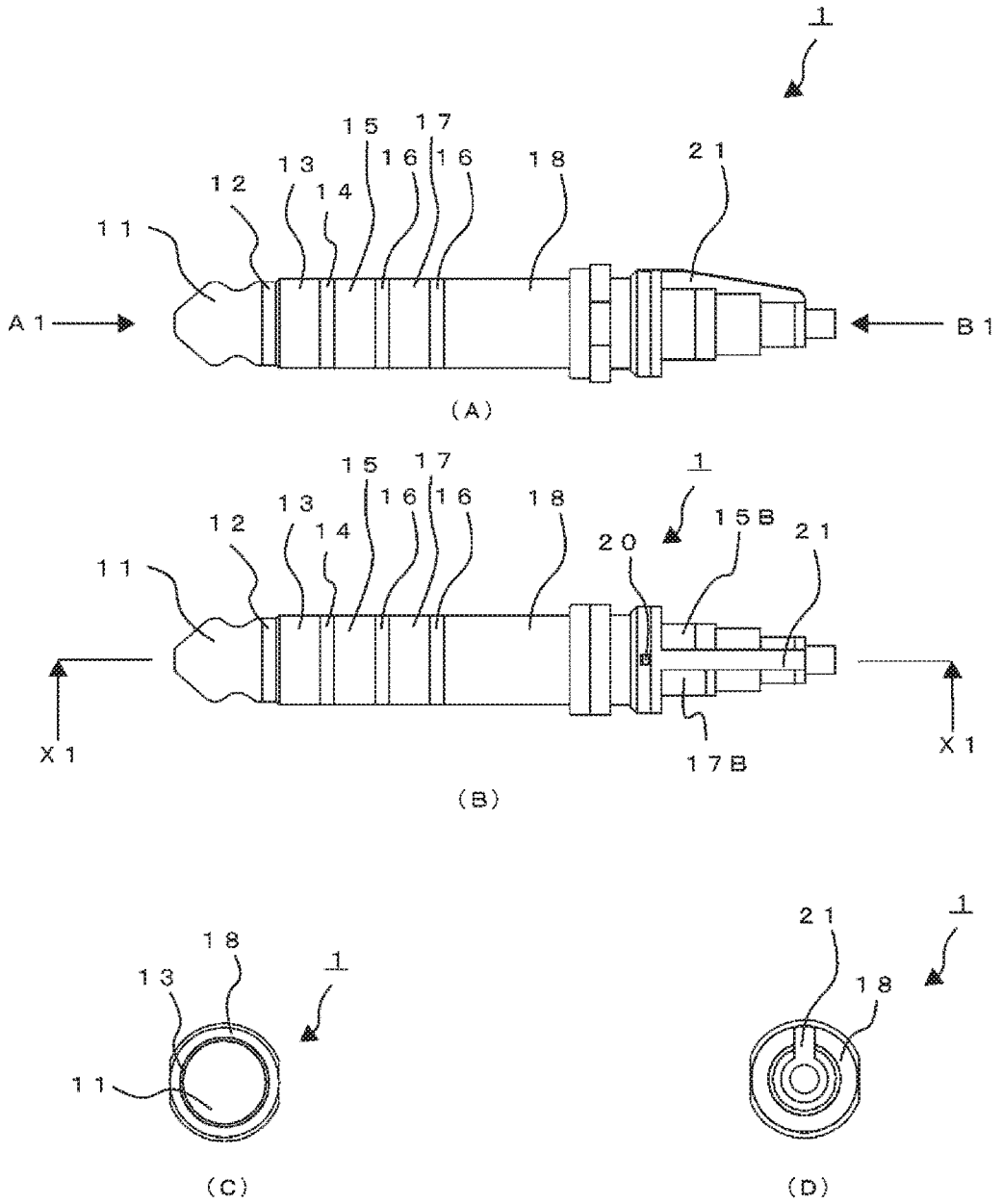
FIG. 1 is a drawing illustrating a multipole plug.

Referring now to the drawings, a multipole plug according to an example of an embodiment of the present invention will be described. In the following embodiment, a five-pole plug will be described as an example. However, a multipole plug 1 may be applied to a multipole plug having four or more plugs.

Figure 2:
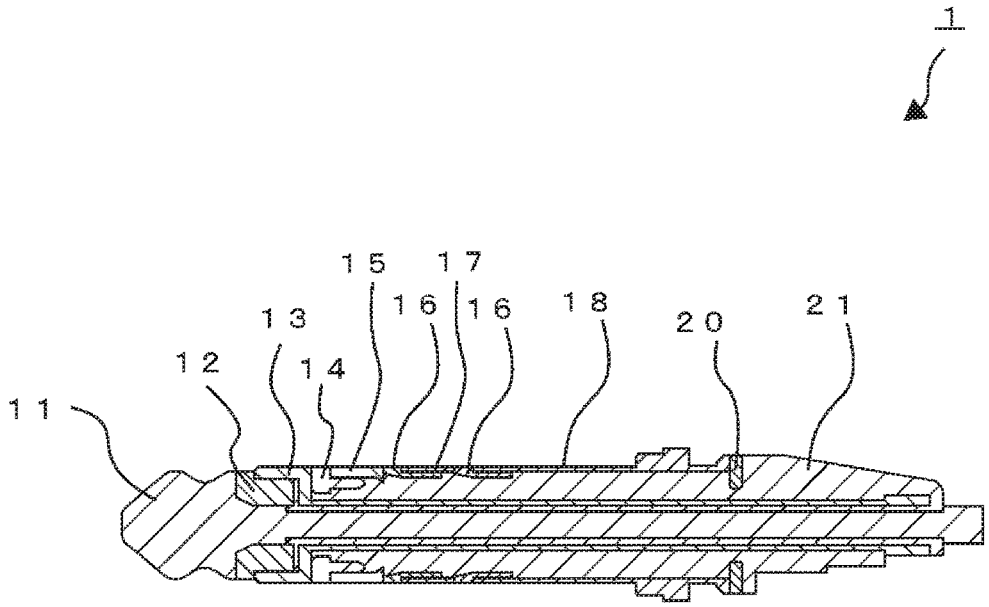
FIG. 2 is a cross-sectional view of the multipole plug taken along a line X1-X1 in FIG. 1(B).

FIG. 1 is a drawing illustrating the multipole plug 1 of the embodiment. FIG. 1(A) is a front view of the multipole plug 1, FIG. 1(B) is a plan view of the multipole plug 1, FIG. 1(C) is a drawing viewed in a direction of an arrow A1 in FIG. 1(A), and FIG. 1(D) is a drawing viewed in a direction of an arrow B1 in FIG. 1(A). FIG. 2 is a cross-sectional view of the multipole plug 1 taken along a line X1-X1 in FIG. 1(B).

As illustrated in FIG. 1 and FIG. 2, the multipole plug 1 comprises a center pin 11 which corresponds to a first pole, a first insulation ring 12, a first sleeve 13 which corresponds to a second pole, a second insulation ring 14, a first terminal strip 15 which corresponds to a third pole, a third insulation ring 16 which is provided between the third pole and a fourth pole, a second terminal strip 17 which corresponds to the fourth pole, a third insulation ring 16 which is provided between the fourth pole and a fifth pole, a second sleeve 18 which corresponds to the fifth pole, a positioning ring 20, and an insulated portion 21.

Outer side surfaces of the first sleeve 13, the second insulation ring 14, the first terminal strip 15, the third insulation ring 16, the second terminal strip 17, and the second sleeve 18 have substantially the same outer diameter when viewed in the direction indicated by the arrow A1. Therefore, the multipole plug 1 has a substantially cylindrical shape.

End potions of the respective poles from the first pole to the fifth pole extend in the interior to the insulated portion 21 and are soldered to a cable.

Figure 3:
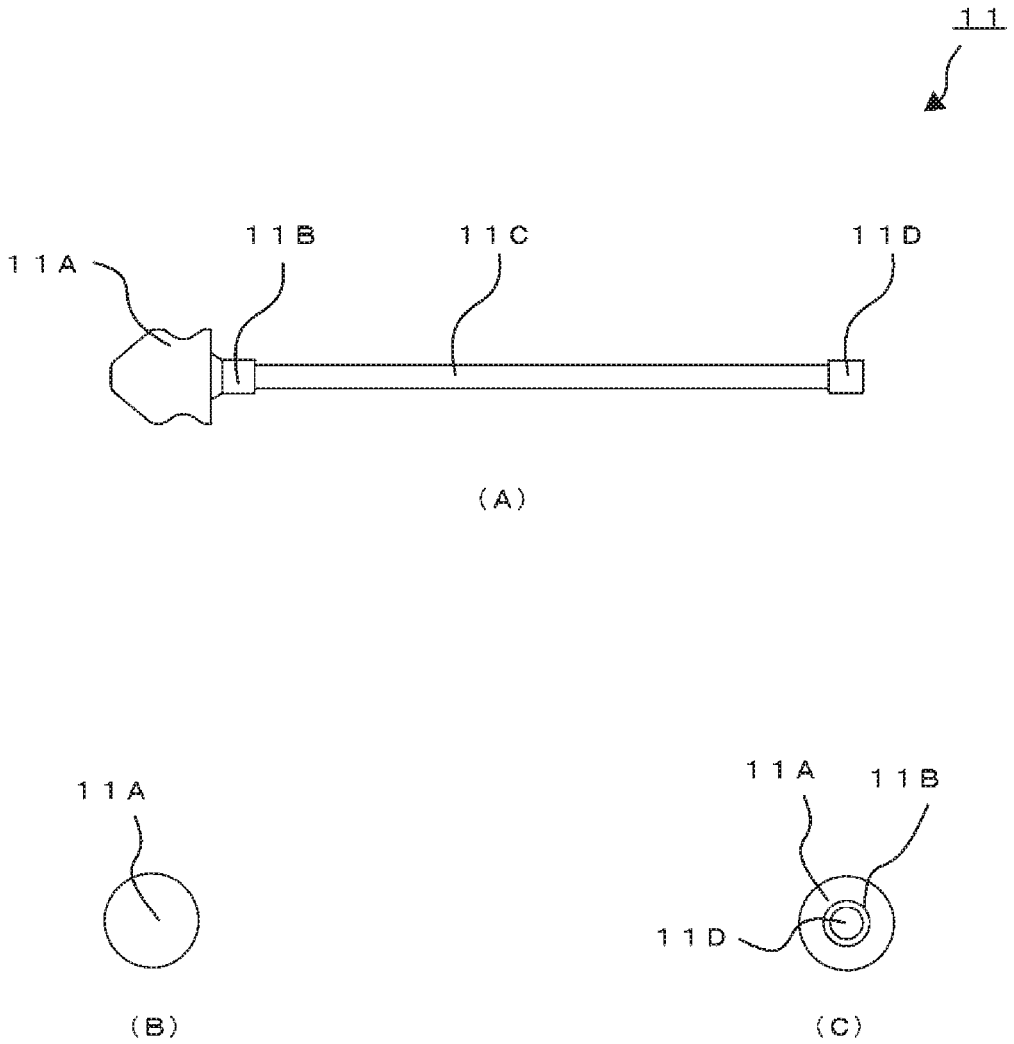
FIG. 3 is a drawing illustrating a center pin.

FIG. 3 is a drawing illustrating the center pin 11. FIG. 3(A) is a front view of the center pin 11, FIG. 3(B) is a left side view of the center pin 11, and FIG. 3(C) is a right side view of the center pin 11. As illustrated in FIG. 3, the center pin 11 comprises a head 11A, a connecting portion 11B, a shaft portion 11C, and a first end portion 11D. The center pin 11 is formed of a conductive material.

The head 11A has an outer diameter which decreases as it goes to a distal end thereof and has a narrowed portion at an axial center portion.

The connecting portion 11B is provided on a bottom portion, which is an end of the head 11A on a side opposite to the distal end portion, and has an outer diameter smaller than the outer diameter of the head 11A. The connecting portion 11B has a taper at a boundary portion with respect to the head 11A, which increases in diameter toward the head 11A.

The shaft portion 11C is connected to the connecting portion 11B, has an outer diameter smaller than the outer diameter of the connecting portion 11B, and extends in an axial direction to the insulated portion 21 when the multipole plug 1 is assembled.

The first end portion 11D has an outer diameter larger than the shaft portion 11C and smaller than the outer diameter of the head 11A and the outer diameter of the connecting portion 11B.

Figure 4:
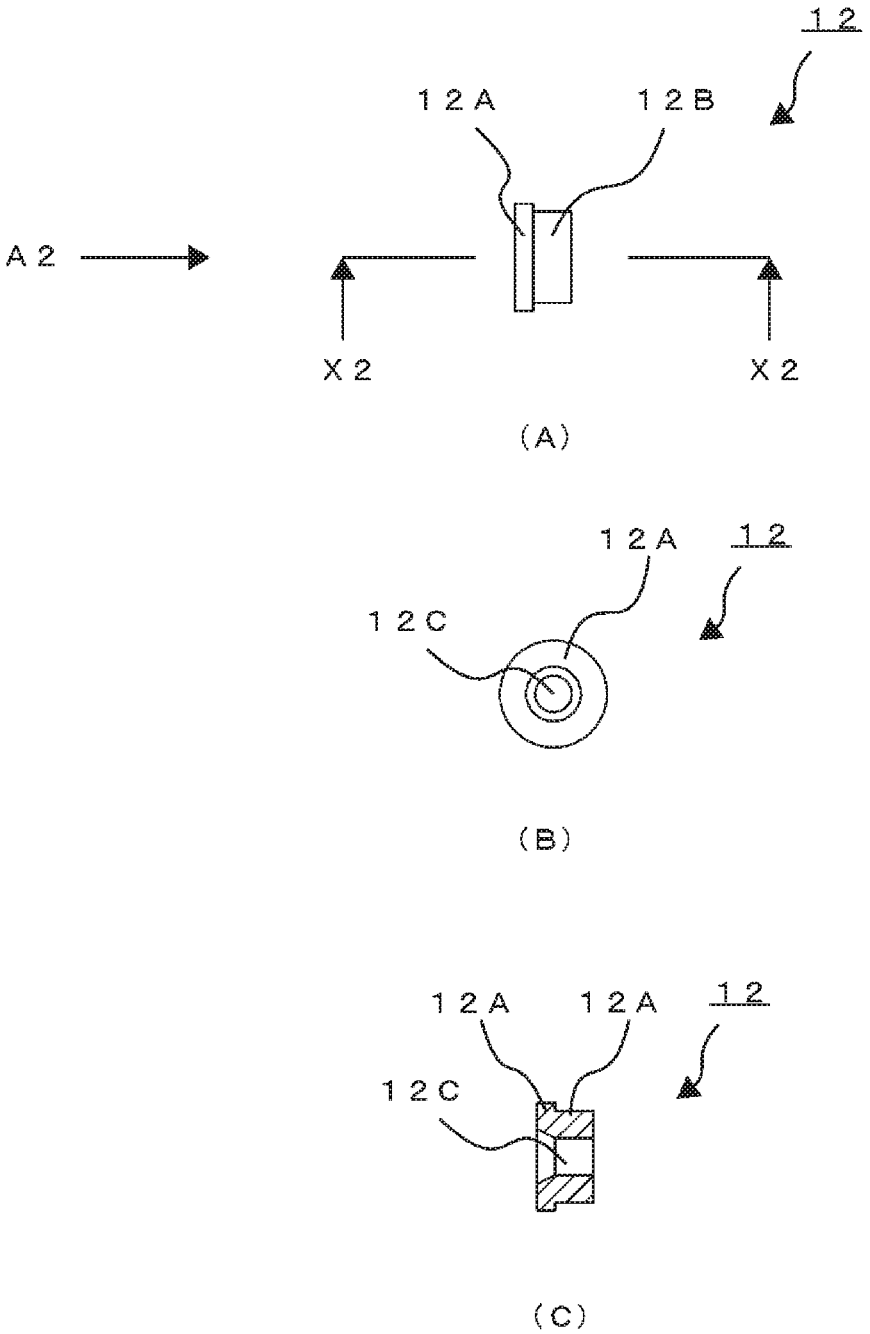
FIG. 4 is a drawing illustrating a first insulation ring.

FIG. 4 is a drawing illustrating the first insulation ring 12. FIG. 4(A) is a front view of the first insulation ring 12, FIG. 4(B) is a drawing of the first insulation ring 12 viewed in a direction indicated by an arrow A2 in FIG. 4(A), and FIG. 4(C) is a cross-sectional view taken along a line X2-X2 in FIG. 4(A). The first insulation ring 12 is formed of an insulating member.

As illustrated in FIG. 4, the first insulation ring 12 comprises a first flange portion 12A and a first base portion 12B.

The first flange portion 12A has a circular shape which has substantially the same outer diameter as the bottom portion of the head 11A when viewed in the direction indicated by the arrow A2.

The first base portion 12B is disposed on the insulated portion 21 side of the first flange portion 12A, and has a cylindrical shape having an outer diameter smaller than the outer diameter of the first flange portion 12A.

The first insulation ring 12 comprises a first through hole 12C penetrating through the first flange portion 12A and the first base portion 12B in the axial direction. The first through hole 12C comprises an opening having a tapered shape in which the taper of the connecting portion 11B of the head 11A is fitted.

Figure 5:
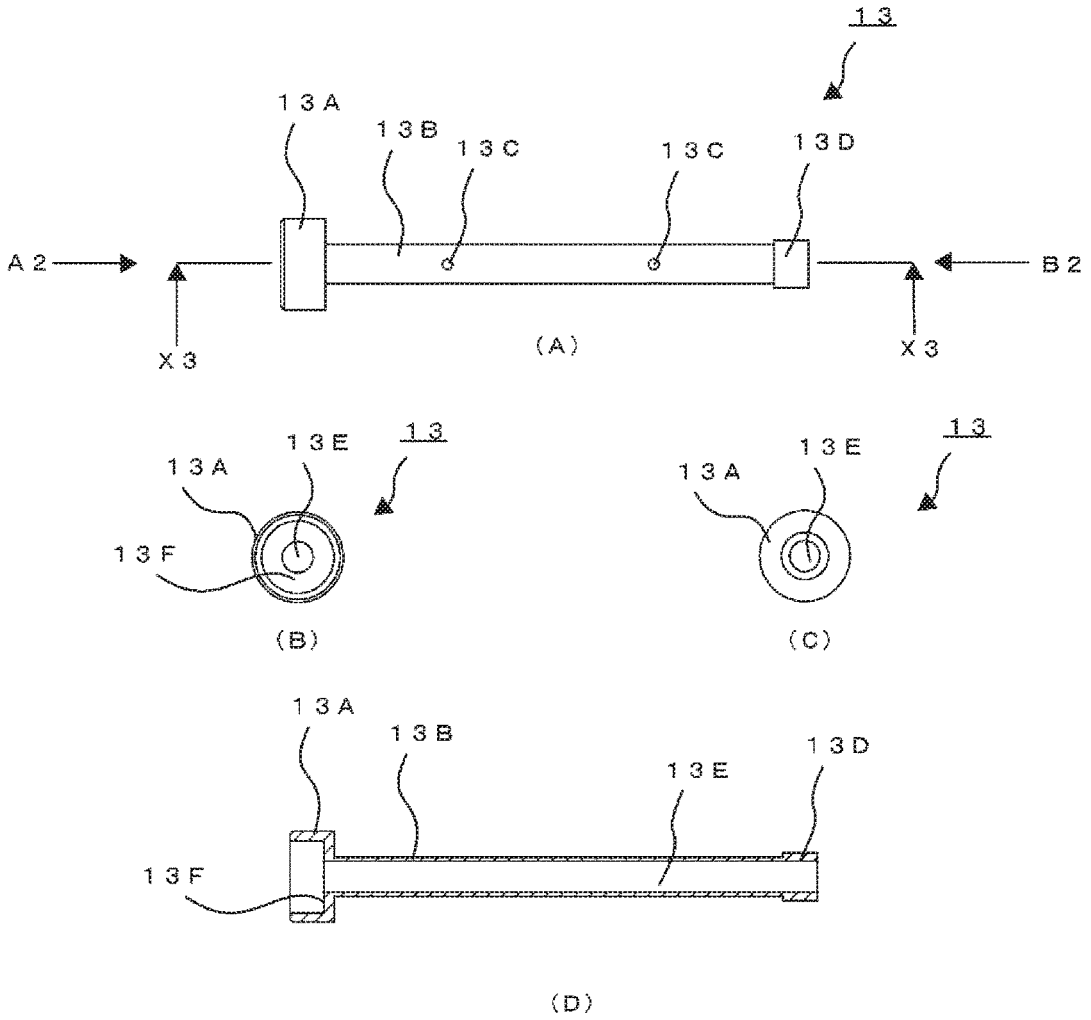
FIG. 5 is a drawing illustrating a first sleeve.

FIG. 5 is a drawing illustrating the first sleeve 13. FIG. 5(A) is a front view of the first sleeve 13, FIG. 5(B) is a drawing viewed in the direction indicated by the arrow A2 in FIG. 5(A), FIG. 5(C) is a drawing viewed in a direction indicated by an arrow B2 in FIG. 5(A), and FIG. 5(D) is a cross-sectional view taken along a line X3-X3 in FIG. 5(A). The first sleeve 13 is formed of a conductive material.

As illustrated in FIG. 5, the first sleeve 13 comprises a first ring portion 13A, a first cylindrical portion 13B comprising first flow holes 13C in a side surface thereof, and a second end portion 13D.

The first ring portion 13A has substantially the same outer diameter as the outer diameter of the first flange portion 12A of the first insulation ring 12.

The first cylindrical portion 13B is disposed at an axial end of the first flange portion 12A and has an outer diameter smaller than the outer diameter of the first ring portion 13A and the outer diameter larger than the outer diameter of the first end portion 11D of the center pin 11. The first cylindrical portion 13B extends in an axial direction until the second end portion 13D reaches the insulated portion 21 when the multipole plug 1 is assembled.

The second end portion 13D is disposed on the side of the first cylindrical portion 13B opposite to the first flange portion 12A, and has an outer diameter larger than the outer diameter of the first cylindrical portion 13B.

The first sleeve 13 comprises a second through hole 13E penetrating through the first ring portion 13A, the first cylindrical portion 13B, and the second end portion 13D in an axial direction. An inner diameter of the second through hole 13E is larger than the outer diameter of the first end portion 11D. The first sleeve 13 comprises a plurality of first flow holes 13C formed in the first cylindrical portion 13B along the axial direction thereof.

The first ring portion 13A comprises a first fitting portion 13F that is fitted to the first base portion 12B in the interior thereof.

Figure 6:
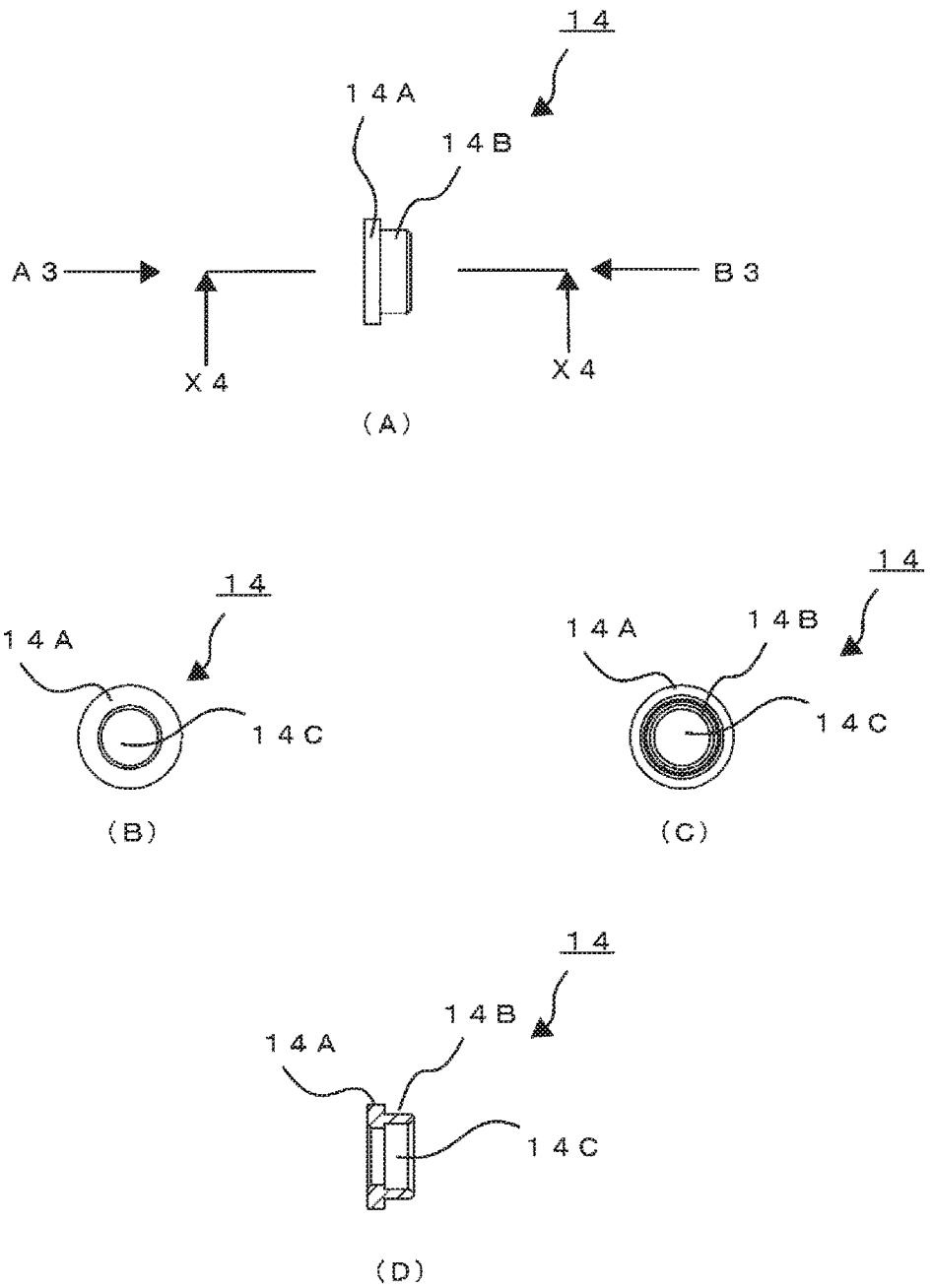
FIG. 6 is a drawing illustrating a second insulation ring.

FIG. 6 is a drawing illustrating the second insulation ring 14. FIG. 6(A) is a front view of the second insulation ring 14, FIG. 6(B) is a drawing of the second insulation ring 14 viewed in a direction indicated by an arrow A3 in FIG. 6(A), FIG. 6(C) is a drawing viewed in a direction indicated by an arrow B3 in FIG. 6(A), and FIG. 6(D) is a cross-sectional view taken along a line X4-X4 in FIG. 6(A). The second insulation ring 14 is formed of an insulating member.

As illustrated in FIG. 6, the second insulation ring 14 comprises a second flange portion 14A and a second base portion 14B.

The second flange portion 14A has a circular shape which has substantially the same outer diameter as the bottom portion of the head 11A when viewed in the direction indicated by the arrow A3 in FIG. 6.

The second base portion 14B is disposed on the insulated portion 21 side of the second flange portion 14A and has a cylindrical shape having an outer diameter smaller than the outer diameter of the second flange portion 14A.

The second insulation ring 14 comprises a second through hole 14C penetrating through the second flange portion 14A and the second base portion 14B in the axial direction.

Figure 7:
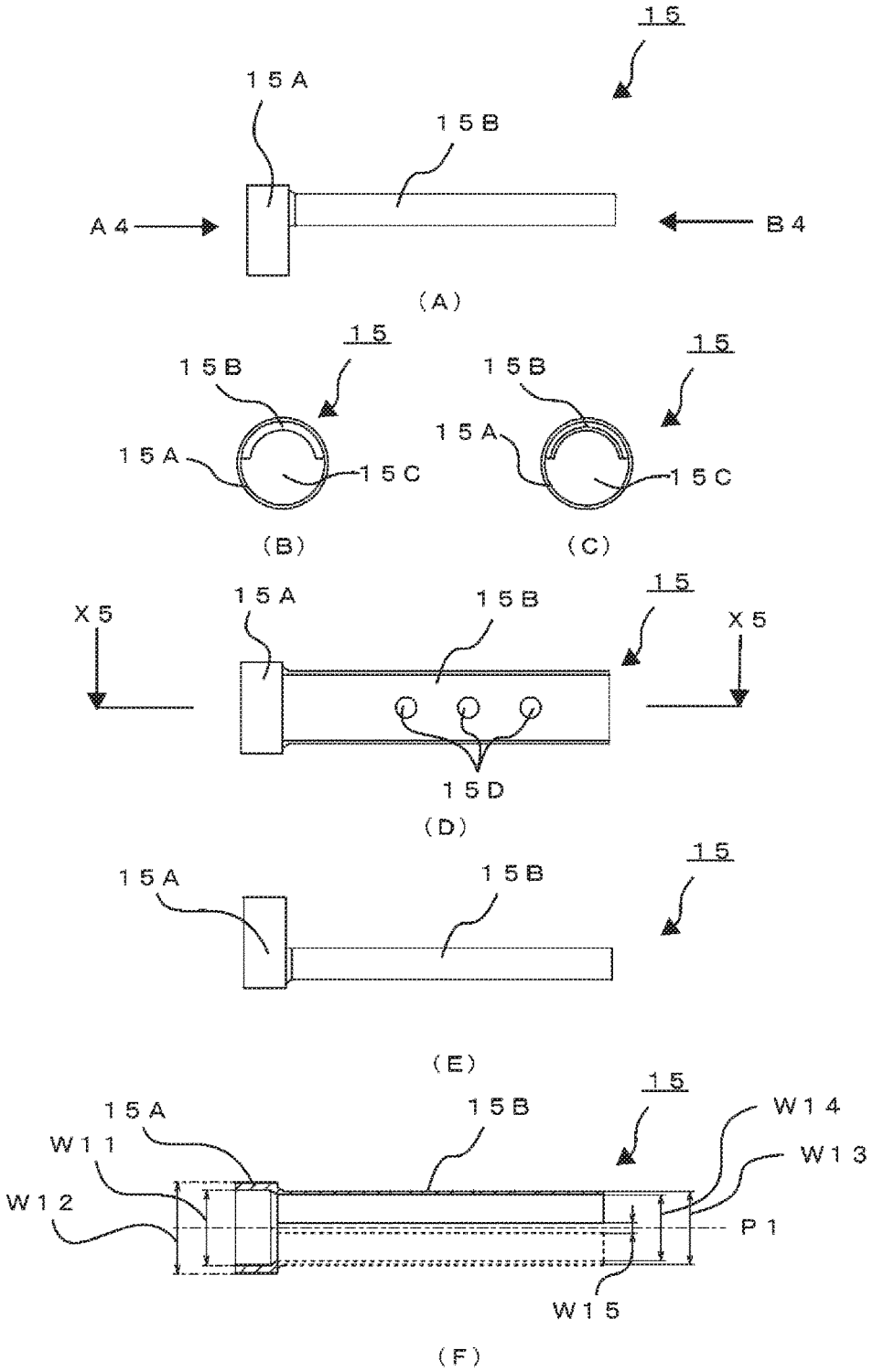
FIG. 7 is a drawing illustrating a first terminal strip.

FIG. 7 is drawing illustrating the first terminal strip 15. FIG. 7(A) is a front view of the first terminal strip 15, FIG. 7(B) is a drawing of the first terminal strip 15 viewed in a direction indicated by an arrow A4 in FIG. 7(A), FIG. 7(C) is a drawing viewed in a direction indicated by an arrow B4 in FIG. 7(A), FIG. 7(D) is a bottom view of the first terminal strip 15, FIG. 7(E) is a rear view of the first terminal strip 15, and FIG. 7(F) is a cross-sectional view of the first terminal strip 15 taken along a line X5-X5 in FIG. 7(D). The first terminal strip 15 is formed of a conductive material.

As illustrated in FIG. 7, the first terminal strip 15 comprises a second ring portion 15A and a first curved plate portion 15B.

The second ring portion 15A has an outer diameter W12 which is substantially the same as the outer diameter of the second flange portion 14A of the second insulation ring 14. An inner diameter W11 of the second ring portion 15A is substantially the same as the outer diameter of the second base portion 14B of the second insulation ring 14.

The first curved plate portion 15B has a shape of a cylinder having an inner diameter W14 larger than the outer diameter of the second end portion 13D of the first sleeve 13, and an outer diameter W13 smaller than the outer diameter of the second ring portion 15A cut along an axial direction so as to be smaller in a circumferential direction than a half by an amount corresponding to a thickness W15 of the insulation layer.

The first curved plate portion 15B is connected at one end thereof to an end portion of the second ring portion 15A and extends until the other end thereof reaches the insulated portion 21 when the multipole plug 1 is assembled.

The first curved plate portion 15B comprises a plurality of second flow holes 15D at a center portion in the circumferential direction along an axial direction.

Figure 8:
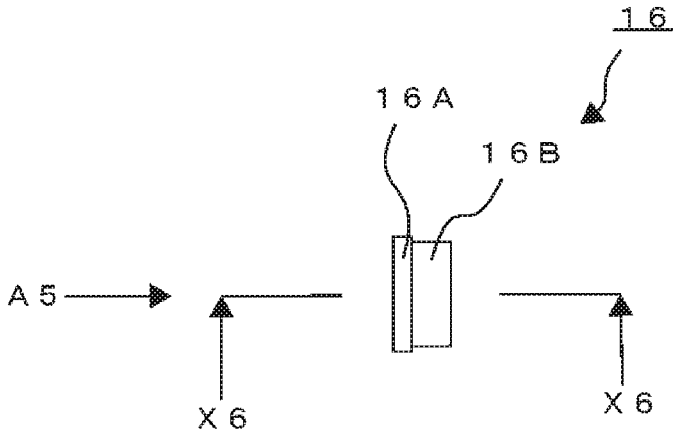
FIG. 8 is a drawing illustrating a third insulation ring.
Figure 8:
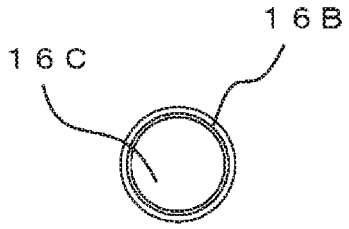
Figure 8:
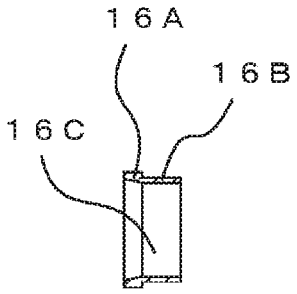

FIG. 8 is a drawing illustrating the third insulation ring 16. FIG. 8(A) is a front view of the third insulation ring 16, FIG. 8(B) is a drawing of the third insulation ring 16 viewed in a direction indicated by an arrow A5 in FIG. 6(A), and FIG. 8(C) is a cross-sectional view taken along a line X6-X6 in FIG. 8(A). The third insulation ring 16 is formed of an insulating member.

As illustrated in FIG. 8, the third insulation ring 16 comprises a third flange portion 16A and a third base portion 16B.

The third flange portion 16A has a circular shape which has substantially the same outer diameter as the outer diameter of the bottom portion of the head 11A when viewed in the direction indicated by the arrow A5 in FIG. 8.

The third base portion 16B is disposed on the insulated portion 21 side of the third flange portion 16A, and has a cylindrical shape having an outer diameter smaller than the outer diameter of the third flange portion 16A.

The third insulation ring 16 comprises a second through hole 16C penetrating through the third flange portion 16A and the third base portion 16B in the axial direction.

Figure 9:
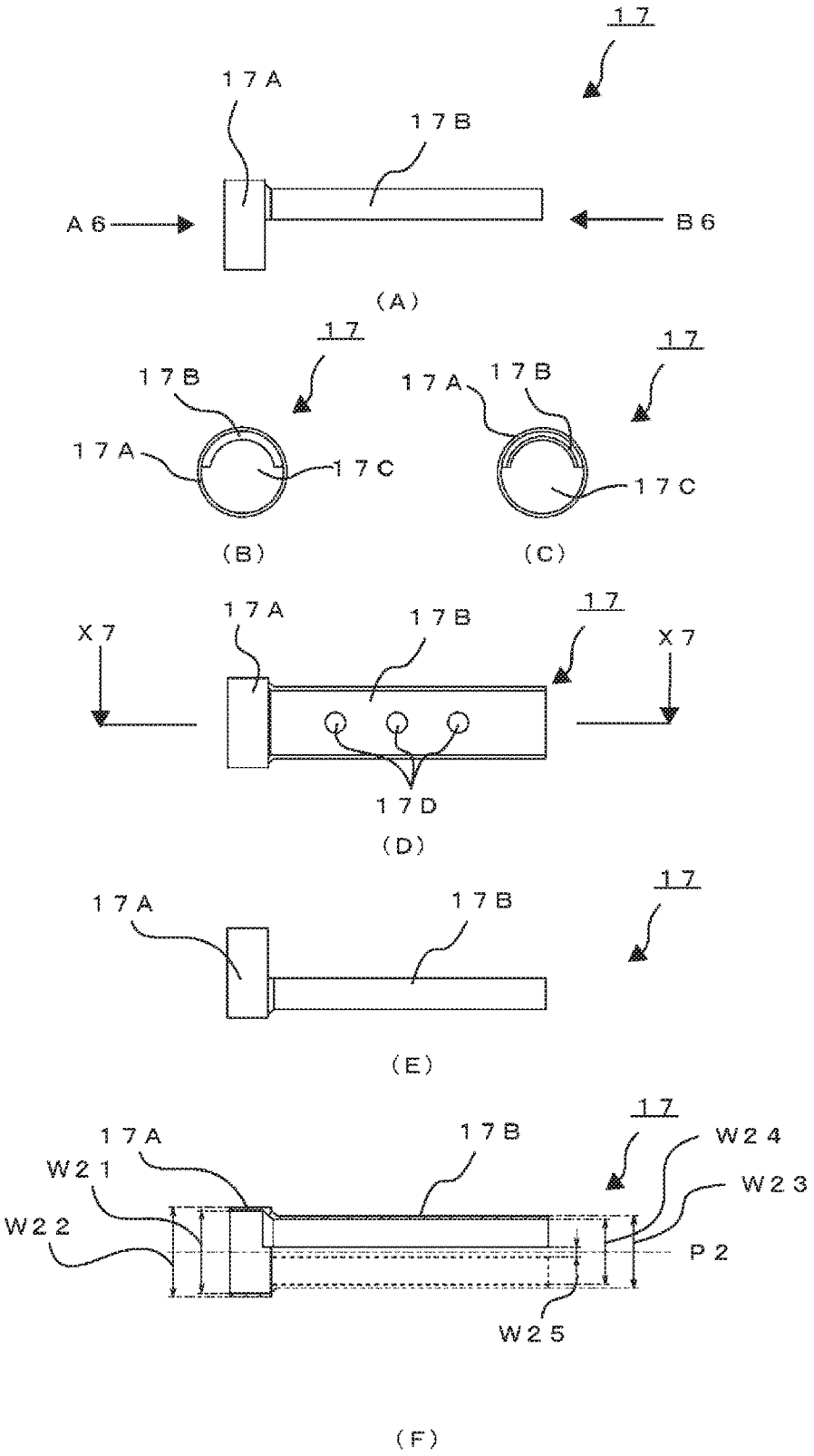
FIG. 9 is a drawing illustrating a second terminal strip.

FIG. 9 is a drawing illustrating a second terminal strip 17. FIG. 9(A) is a front view of the second terminal strip 17, FIG. 9(B) is a drawing of the second terminal strip 17 viewed in a direction indicated by an arrow A6 in FIG. 9(A), FIG. 9(C) is a drawing viewed in a direction indicated by an arrow B6 in FIG. 9(A), FIG. 9(D) is a bottom view of the second terminal strip 17, FIG. 9(E) is a rear view of the second terminal strip 17, and FIG. 9(F) is a cross-sectional view of the second terminal strip 17 taken along a line X7-X7 in FIG. 9(D). The second terminal strip 17 is formed of a conductive material.

As illustrated in FIG. 9, the second terminal strip 17 comprises a third ring portion 17A and a second curved plate portion 17B.

The third ring portion 17A has an outer diameter W22 which is substantially the same as the outer diameter of the third flange portion 16A of the third insulation ring 16. An inner diameter W21 of the third ring portion 17A is substantially the same as the outer diameter of the third base portion 16B of the third insulation ring 16.

The second curved plate portion 17B has a shape of a cylinder having an inner diameter W24 larger than the outer diameter of the second end portion 13D of the first sleeve 13, and an outer diameter W23 smaller than the outer diameter of the third ring portion 17A cut along an axial direction so as to be smaller in a circumferential direction than a half by an amount corresponding to a thickness W25 of the insulation layer.

The second curved plate portion 17B is connected at one end thereof to an end portion of the third ring portion 17A and extends in the axial direction until the other end thereof reaches the insulated portion 21 when the multipole plug 1 is assembled.

The second curved plate portion 17B comprises a plurality of third flow holes 17D at a center portion in the circumferential direction along an axial direction.

The axial length of the first curved plate portion 15B here is different from the axial length of the second curved plate portion 17B. Specifically, the axial length of the first curved plate portion 15B is shorter than the axial length of the second curved plate portion 17B. Therefore, when the multipole plug 1 is assembled, as illustrated in FIG. 1(B), an exposed length of the first curved plate portion 15B on the insulated portion 21 side, which is an end portion on the side connected to a line, is shorter than an exposed length of the second curved plate portion 17B. Therefore, confusion of poles to be connected at the time of soldering is effectively avoided.

Figure 10:
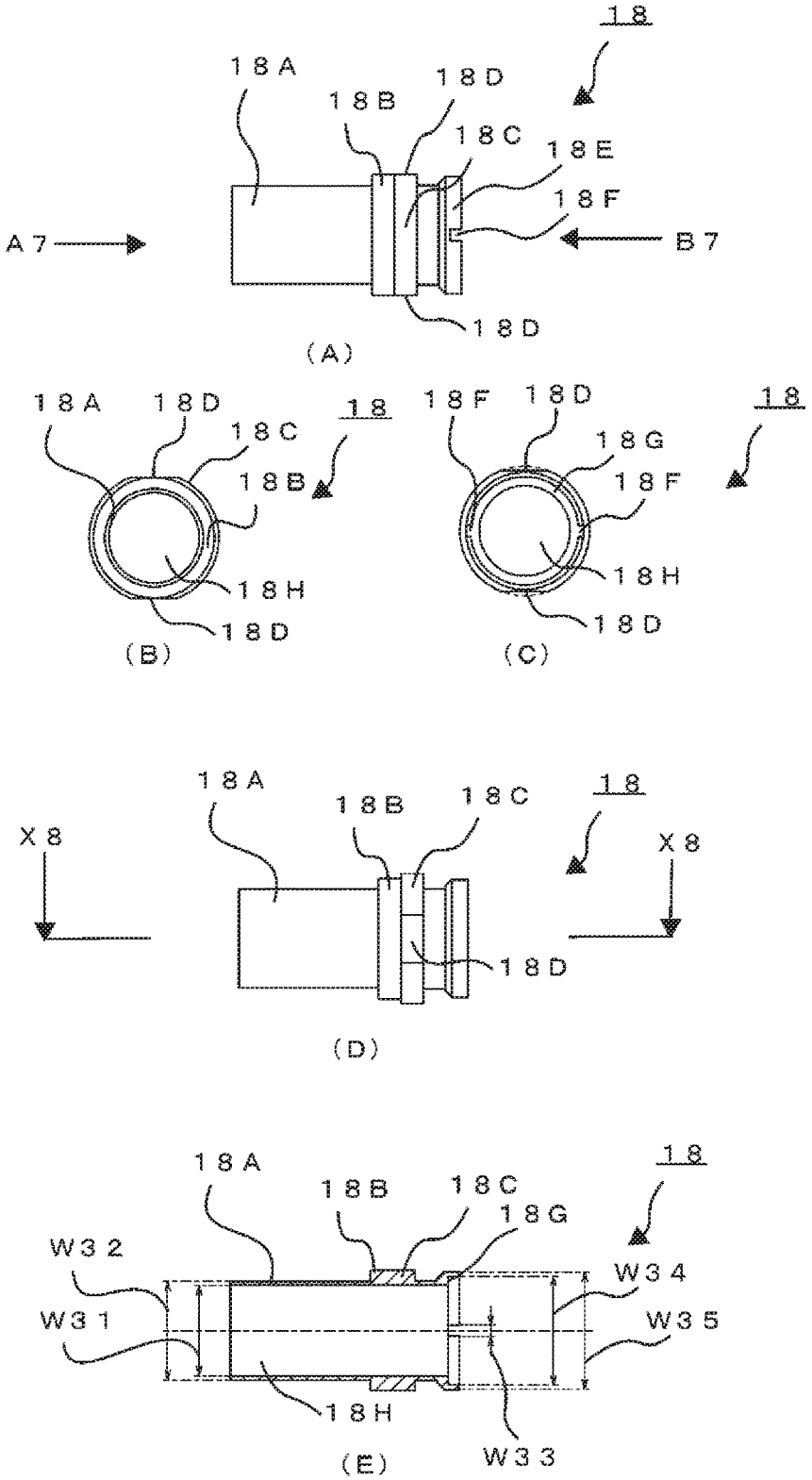
FIG. 10 is a drawing illustrating a second sleeve.

FIG. 10 is a drawing illustrating the second sleeve 18. FIG. 10(A) is a front view of the second sleeve 18, FIG. 10(B) is a drawing of the second sleeve 18 viewed in a direction of an arrow A7, FIG. 10(C) is a drawing of the second sleeve 18 viewed in a direction of an arrow B7 in FIG. 10(A), FIG. 10(D) is a plan view of the second sleeve 18, and FIG. 10(E) is a cross-sectional view of the second sleeve 18 taken along a line X8-X8 in FIG. 10(D).

As illustrated in FIG. 10, the second sleeve 18 comprises a second cylindrical portion 18A, a fourth ring portion 18B, a fifth ring portion 18C, and a fourth flange portion 18E.

The second cylindrical portion 18A has an outer diameter W32 which is substantially the same as the outer diameter W22 of the third ring portion 17A, and an inner diameter W31 which is larger than an outer diameter when the first curved plate portion 15B and the second curved plate portion 17B are assembled.

The fourth ring portion 18B and the fifth ring portion 18C are disposed on the insulated portion 21 side of the second cylindrical portion 18A. Inner diameters of the fourth ring portion 18B and the fifth ring portion 18C are the same as the inner diameter W31 of the second cylindrical portion 18A.

The fifth ring portion 18C comprises flat portions 18D cut into a flat plane on an upper surface and a lower surface.

The fourth flange portion 18E has an outer diameter W35 and an inner diameter W34 both larger than the outer diameter W32 of the second cylindrical portion 18A. The fourth flange portion 18E comprises two notched portions 18F at two positions in a circumferential direction.

The second sleeve 18 comprises a through hole 18H penetrating therethrough in an axial direction.

Figure 11:
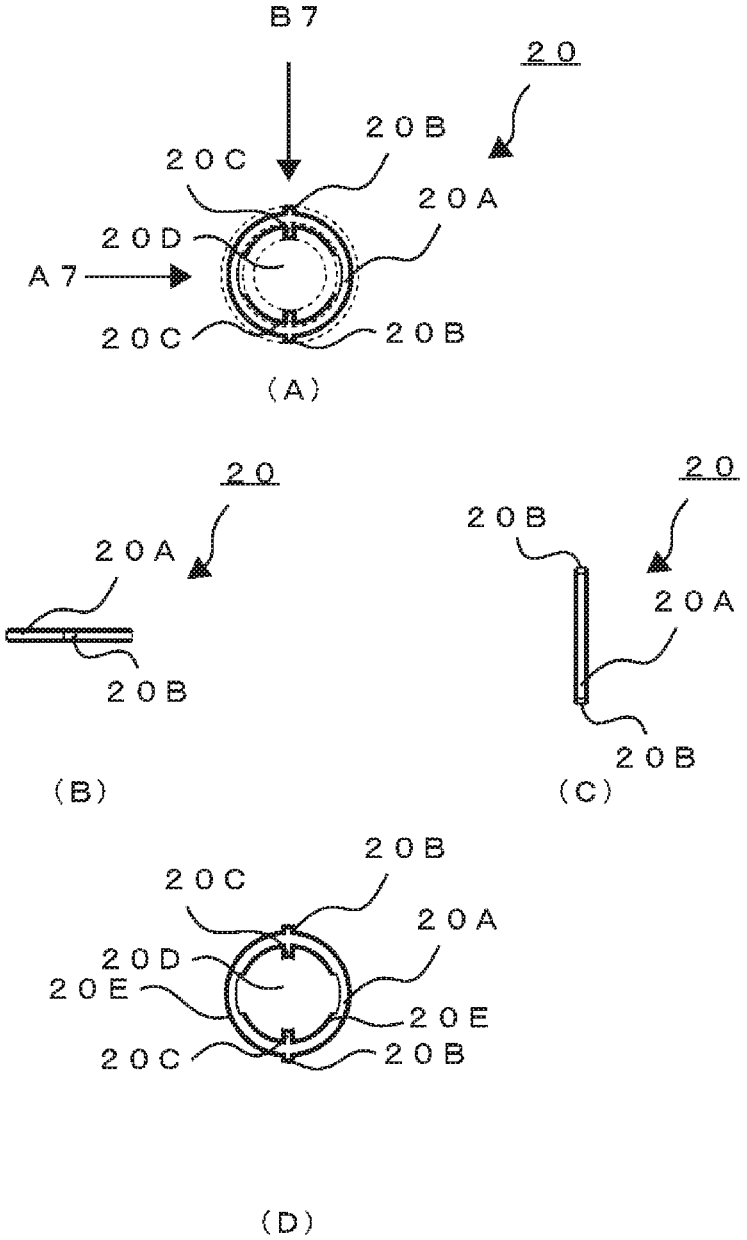
FIG. 11 is a drawing illustrating a positioning ring.

FIG. 11 is a drawing illustrating the positioning ring 20. FIG. 11(A) is a plan view of the positioning ring 20, FIG. 11(B) is a drawing of the positioning ring 20 viewed in a direction indicated by an arrow B7 in FIG. 11(A), FIG. 11(C) is a drawing of the positioning ring 20 viewed in a direction indicated by an arrow A7 in FIG. 11(A), and FIG. 11(D) is a bottom view of the positioning ring 20. The positioning ring is formed of an insulating member.

As illustrated in FIG. 11, the positioning ring 20 is formed into a substantially annular shaped ring form in plan view comprising a through hole 20D penetrating in a thickness direction, and comprises on an inner side thereof two inner projecting portions 20C having a thickness which is substantially the same as the thickness of a resin layer, which corresponds to a gap formed when the first curved plate portion 15B and the second curved plate portion 17B are assembled, and outer projecting portions 20B having positions and width to be fitted into the notched portions 18F of the second sleeve 18.

The positioning ring 20 comprises a chamfered portions 20E chamfered obliquely on an outside and an inside.

Figure 12:
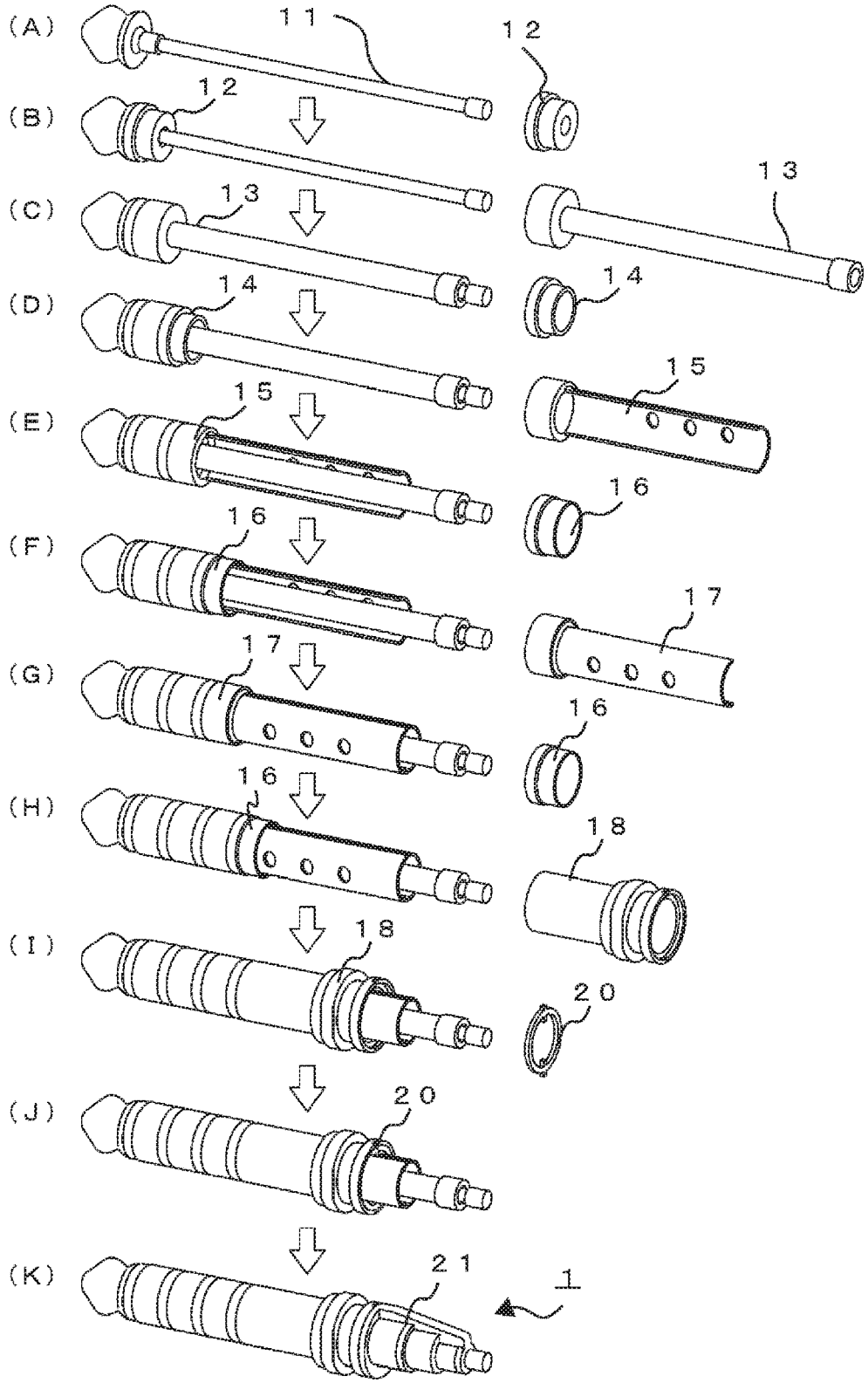
FIG. 12 is a drawing illustrating an assembly procedure of the multipole plug.

FIG. 12 is a drawing illustrating an assembly procedure of the multipole plug 1.

First, the first insulation ring 12 is fitted into the center pin 11 as illustrated in FIG. 12(A).

Subsequently, the first sleeve 13 is fitted into the center pin 11 as illustrated in FIG. 12(B).

Next, the second insulation ring 14 is fitted into the center pin 11 as illustrated in FIG. 12(C).

Next, the first terminal strip 15 is fitted into the center pin 11 as illustrated in FIG. 12(D). In this case, the first terminal strip 15 is disposed so that the second ring portion 15A is fitted into the shaft portion 11C, and the first curved plate portion 15B extends along the shaft portion 11C.

Next, the third insulation ring 16 is fitted into the center pin 11 as illustrated in FIG. 12(E).

Next, the second terminal strip 17 is fitted into the center pin 11 as illustrated in FIG. 12(F). In this case, the second terminal strip 17 is disposed so that the third ring portion 17A is fitted into the shaft portion 11C, and the second curved plate portion 17B extends along the shaft portion 11C.

Next, the third insulation ring 16 is fitted into the center pin 11 as illustrated in FIG. 12(G).

Next, the second sleeve 18 is fitted into the center pin 11 as illustrated in FIG. 12(H).

Next, as illustrated in FIG. 12(I), the positioning ring 20 is assembled to the second sleeve 18 so that the inner projecting portions 20C of the positioning ring 20 fit into a gap formed when the first curved plate portion 15B and the second curved plate portion 17B are assembled, and the outer projecting portions 20B fit into the notched portions 18F of the second sleeve 18. This state is illustrated in FIG. 12(J).

Finally, the multipole plug 1 is formed as illustrated in FIG. 12(K) by putting the assembly into a shaping die frame, injecting an insulating resin therein, and solidifying the insulating resin.

As illustrated thus far, in the multipole plug 1 of the embodiment, the first sleeve portion (first sleeve 13) comprises the first flow holes 13C in the first cylindrical portion 13B, the first terminal strip (first terminal strip 15) comprises the second flow holes (second flow holes 15D) in the first curved plate portion 15B, the second terminal strip (second terminal strip 17) comprises the third flow holes (the third flow holes 17D) in the second curved plate portion 17B, and the first curved plate portion 15B and the second curved plate portion 17B are positioned by the positioning ring 20 provided with the outer projecting portions 20B to be fitted to the notched portions 18F of the second sleeve portion 18 (second sleeve 18) and the inner projecting portions 20C to be fitted into a gap between the first curved plate portion 15B and the second curved plate portion 17B being fitted thereto.

Specifically, the multipole plug 1 comprises: a center pin (center pin 11) comprising a head and a shaft portion, the center pin corresponding to a first pole; a first sleeve portion (first sleeve 13) formed into a cylindrical shape comprising a first flow hole in a side surface thereof, and being disposed outside the shaft portion, the first sleeve portion corresponding to a second pole; a first terminal strip (first terminal strip 15) having a shape of an annular first ring portion and a cylinder to be fitted onto the shaft portion and divided in a circumferential direction and separated along an axial direction, being disposed outside the first sleeve portion along the first sleeve portion, and comprising a first curved plate portion comprising a second flow hole, the first terminal strip corresponding to a third pole; a second terminal strip (second terminal strip 17) having a shape of an annular second ring portion and a cylinder to be fitted onto the shaft portion and divided in a circumferential direction and separated along an axial direction, being disposed outside the first sleeve portion along the first sleeve portion so as to oppose the first curved plate portion, and comprising a second curved plate portion comprising a third flow hole, the second terminal strip corresponding to a fourth pole; a second sleeve portion having a notched portion notched in a radially inwardly and being disposed outside the first terminal strip and the second terminal strip, the second sleeve portion corresponding to a fifth pole; a positioning ring comprising an inner projecting portion fitted to a gap between the first terminal strip and the second terminal strip and an outer projecting portion fitted to the notched portion, and being formed into an annular shape, and an insulating resin that insulates the respective poles from the first pole to the fifth pole from each other.

The multipole plug 1 may be configured to have four poles by omitting the first sleeve portion (first sleeve 13).

In this case, the multipole plug 1 comprises: a center pin (center pin 11) comprising a head and a shaft portion, the center pin corresponding to a first pole; a first terminal strip (first terminal strip 15) having a shape of an annular first ring portion and a cylinder to be fitted onto the shaft portion and divided in a circumferential direction and separated along an axial direction, being disposed along the shaft portion, and comprising a first curved plate portion comprising a second flow hole, the first terminal strip corresponding to a second pole; a second terminal strip (second terminal strip 17) having a shape of an annular second ring portion and a cylinder to be fitted onto the shaft portion and divided in a circumferential direction and separated along an axial direction, being disposed along the shaft portion so as to oppose the first curved plate portion, and comprising a second curved plate portion comprising a third flow hole, the second terminal strip corresponding to a third pole; a second sleeve portion having a notched portion notched in a radially inwardly and being disposed outside the first terminal strip and the second terminal strip, the second sleeve portion corresponding to a fourth pole; a positioning ring comprising an inner projecting portion fitted to a gap between the first terminal strip and the second terminal strip and an outer projecting portion fitted to the notched portion, and being formed into an annular shape; and an insulating resin that insulates the respective poles from the first pole to the fourth pole from each other.

The insulating resin easily enters gaps of the respective poles through the first flow holes 13C, the second flow holes 15D, and the third flow holes 17D.

Therefore, the resin can be advantageously injected easily between the terminal strips of respective poles.

In addition, the positioning of the first curved plate portion 15B and the second curved plate portion 17B is achieved by the positioning ring 20 being short in axial length.

Therefore, the length of the plug may be advantageously shortened.

In addition, since the first curved plate portion 15B and the second curved plate portion 17B have larger cross-sectional areas than the multipole plug of related art, reduction of a resistance value is enabled, so that a reproduction sound quality is advantageously improved when being applied to speakers and headphones which reproduce sounds.

REFERENCE SIGNS LIST

1 multipole plug
11 center pin
11A head
11B connecting portion
11C shaft portion
11D first end portion
12 first insulation ring
12A first flange portion
12B first base portion
12C first through hole
13 first sleeve
13A first ring portion
13B first cylindrical portion
13C first flow hole
13D second end portion
13E second through hole
13F first fitting portion
14 second insulation ring
14A second flange portion
14B second base portion
14C second through hole
15 first terminal strip
15A second ring portion
15B first curved plate portion
15D second flow hole
16 third insulation ring
16A third flange portion
16B third base portion
16C second through hole
17 second terminal strip
17A third ring portion
17B second curved plate portion
17D third flow hole
18 second sleeve
18A second cylindrical portion
18B fourth ring portion
18C fifth ring portion
18D flat portion
18E fourth flange portion
18F notched portion
18H through hole
20 positioning ring
20B outer projecting portion
20C inner projecting portion
20D through hole
20E chamfered portion
21 insulated portion

The invention claimed is:

1. A multipole plug, comprising:

a center pin comprising a head and a shaft portion, the center pin corresponding to a first pole;

a first sleeve portion formed into a cylindrical shape, comprising a first flow hole in a side surface thereof, and being disposed outside the shaft portion, the first sleeve portion corresponding to a second pole;

a first terminal strip having a shape of an annular first ring portion and a cylinder to be fitted onto the shaft portion and divided in a circumferential direction and separated along an axial direction, being disposed outside the first sleeve portion along the first sleeve portion, and comprising a first curved plate portion comprising a second flow hole, the first terminal strip corresponding to a third pole;

a second terminal strip having a shape of an annular second ring portion and a cylinder to be fitted onto the shaft portion and divided in a circumferential direction and separated along an axial direction, being disposed outside the first sleeve portion along the first sleeve portion so as to oppose the first curved plate portion, and comprising a second curved plate portion comprising a third flow hole, the second terminal strip corresponding to a fourth pole;

a second sleeve portion having a notched portion notched in a radially inwardly and being disposed outside the first terminal strip and the second terminal strip, the second sleeve portion corresponding to a fifth pole; and an insulating resin that insulates the respective poles from the first pole to the fifth pole from each other.

2. A multipole plug, comprising:

a center pin comprising a head and a shaft portion, the center pin corresponding to a first pole;

a first terminal strip having a shape of an annular first ring portion and a cylinder to be fitted onto the shaft portion and divided in a circumferential direction and separated along an axial direction, being disposed along the shaft portion, and comprising a first curved plate portion comprising a second flow hole, the first terminal strip corresponding to a second pole;

a second terminal strip having a shape of an annular second ring portion and a cylinder to be fitted onto the shaft portion and divided in a circumferential direction and separated along an axial direction, being disposed along the shaft portion so as to oppose the first curved plate portion, and comprising a second curved plate portion comprising a third flow hole, the second terminal strip corresponding to a third pole;

a second sleeve portion having a notched portion notched in a radially inwardly and being disposed outside the first terminal strip and the second terminal strip, the second sleeve portion corresponding to a fourth pole; and an insulating resin that insulates the respective poles from the first pole to the fourth pole from each other.

* * * * *